United States Patent [19]

Slomka

[11] Patent Number: 5,027,425

[45] Date of Patent: Jun. 25, 1991

[54] FLOW-THROUGH HEATER, PARTICULARLY FOR A COFFEE OR TEA MAKER

[75] Inventor: Hans-Jürgen Slomka, Minden, Fed. Rep. of Germany

[73] Assignee: Melitta-Werke Bentz & Sohn, Minden, Fed. Rep. of Germany

[21] Appl. No.: 326,045

[22] Filed: Mar. 20, 1989

[30] Foreign Application Priority Data

Mar. 30, 1988 [DE] Fed. Rep. of Germany ..... 3810736

[51] Int. Cl.[5] ..... F24H 1/10

[52] U.S. Cl. ..... 392/480

[58] Field of Search ..... 428/36.9, 210; 219/301, 219/298, 299, 543; 338/242, 293, 294, 301, 302, 308, 309; 392/479, 480, 304

[56] References Cited

U.S. PATENT DOCUMENTS

| | | | |
|---|---|---|---|
| 787,047 | 4/1905 | Leonard | 219/301 |
| 869,464 | 10/1907 | Stevens | 219/299 |
| 974,329 | 11/1910 | Aalborg | 219/301 |
| 1,696,758 | 12/1928 | Galdi et al. | 219/298 |
| 1,881,444 | 10/1932 | Flanzer | 219/301 |
| 2,859,321 | 11/1958 | Garaway | 219/301 |
| 4,334,141 | 6/1982 | Roller et al. | 219/301 |
| 4,345,142 | 8/1982 | Dietze | 219/301 |

FOREIGN PATENT DOCUMENTS

| | | | |
|---|---|---|---|
| 2454920 | 5/1976 | Fed. Rep. of Germany | 219/301 |
| 2002175 | 2/1979 | United Kingdom | 338/294 |

*Primary Examiner*—Geoffrey S. Evans

*Attorney, Agent, or Firm*—Spencer & Frank

[57] ABSTRACT

A flow through fluid heater having a tubular hollow body having a flattened region on which is printed and sintered a resistive paste to form an electric heating element. The hollow body can be made of aluminum oxide or steel with a ceramic coating.

5 Claims, 3 Drawing Sheets

FIG. 5
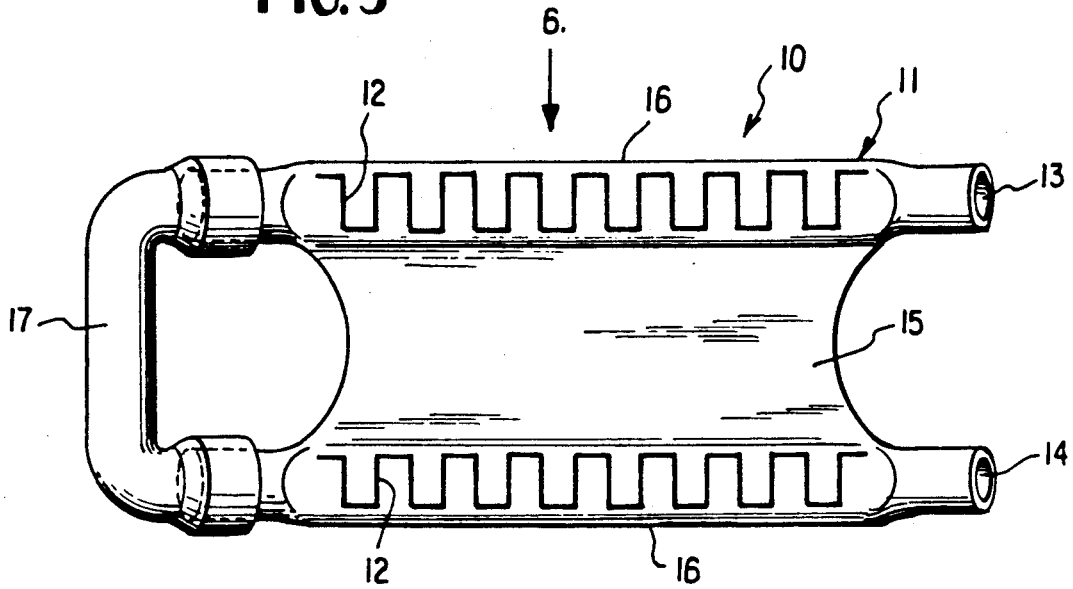
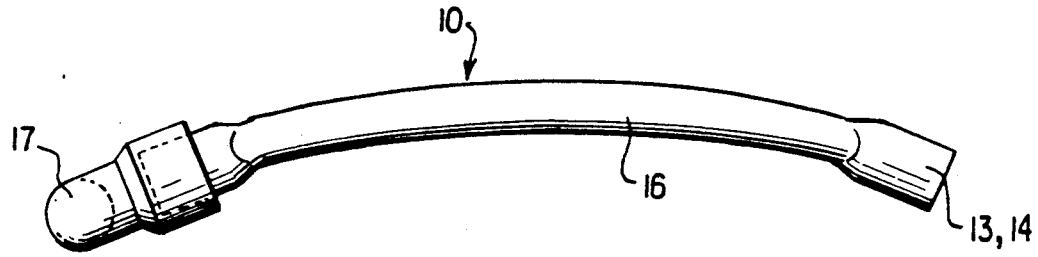
FIG. 6
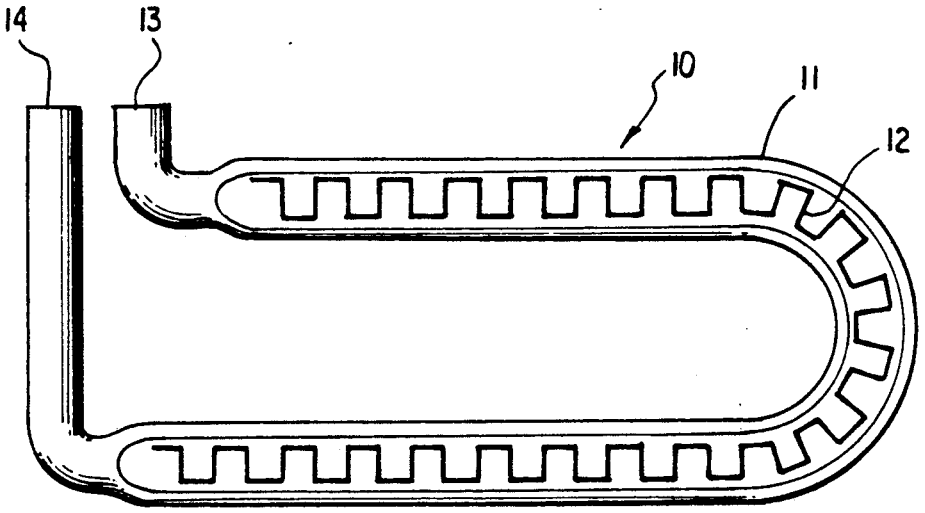
FIG. 7

FLOW-THROUGH HEATER, PARTICULARLY FOR A COFFEE OR TEA MAKER

FIELD OF THE INVENTION

The present invention relates to a flow-through heater, particularly for a coffee or tea maker, composed of a hollow body provided with an inlet and an outlet and with an electrical resistance heating element which completely or partially surrounds the hollow body.

TECHNOLOGY REVIEW

Flow-through heaters of this type are known in various forms.

In addition to the use of such flow-through heaters for coffee or tea makers, other uses are also known for flow-through heaters which all employ the same operational principle, namely that a medium to be heated flows into the flow-through heater through its inlet, is heated in it while flowing through the hollow body and leaves the flow-through heater again through its outlet.

In prior art flow-through heaters, the electrical resistance heating element is composed of heating wires or flat heaters which are wound around the hollow body or are cast completely or partially into the hollow body.

This structural principle has a negative influence on the size of the prior art flow-through heater and also on its design possibilities. The heating wires surrounding the hollow body enlarge the total volume of the prior art flow-through heaters, with the overall dimensions of prior art flow-through heaters in any case having to be rather large to produce the respectively required heating power.

In designing the, prior art flow-through heaters, the engineer has had to take care that it remains possible to wind the resistance wires around the heater or cast the wires into the heater so that his freedom of design is limited considerably in the sense of optimum adaptation to the intended purpose.

SUMMARY OF THE INVENTION

It is the object of the present invention to create a flow-through heater of this type which is small and can be oriented almost without limits to its respective purpose of use or application.

This object is accomplished by the invention by providing a body composed of an electrically non-conductive material or having a thin insulating coating and an electrical resistance heating element composed of a resistive paste printed and sintered onto at least partial regions of the exterior surface of the hollow body.

Due to the fact that the electrical resistance heating element is printed and sintered onto the hollow body, on the one hand, an increase in the volume of the entire flow-through heater because of the resistance heating element itself is practically avoided and the advantage is realized, on the other hand, that the flow-through heater can be adapted in a substantially optimum manner to its respective intended purpose since practically the only factor to be considered in its design is that it must be possible to imprint the hollow body with an appropriate resistive paste.

By using an electrically non-conductive material or an electrically conductive material which, however, is provided with a thin insulating layer, the electrical safety of such a flow-through heater is ensured without difficulty.

The imprinting of such materials with appropriate resistive pastes and sintering on these resistive pastes for the purpose of forming heating elements is known per se under the term of hybrid heating elements. However, in the past, such hybrid heating elements have been produced and employed exclusively as contact heating elements which serve to transfer heat to other components. The use of conventional hybrid heating elements for flow-through heaters would thus not bring any advantage over the prior art.

Further features of the invention are described below.

Embodiments of the invention are illustrated in the attached drawing figures and will be described in greater detail below.

BRIEF DESCRIPTION OF THE DRAWINGS

FIG. 5 is a top view of a flow-through heater according to a further embodiment of the invention;

FIG. 6 is a view in the direction of arrow VI of FIG. 5;

FIG. 7 is a top view of a flow-through heater according to a further embodiment of the invention;

DESCRIPTION OF THE PREFERRED EMBODIMENTS

Figure 1:
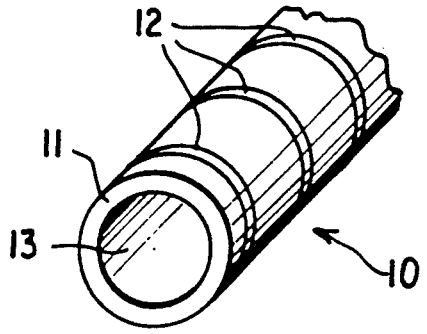
FIG. 1 is a perspective partial view of tubular flow-through heater.

FIG. 1 shows in a perspective view a tubular flow-through heater which in its entirety is marked with the reference numeral 10. This flow-through heater 10 is composed of a hollow body 11 in the form of a tube and a resistive paste 12 printed and sintered onto this hollow body to serve as an electrical resistance heating element.

Hollow body 11 is either produced of an electrically non-conductive material or is composed of an electrically conductive material which is provided with a thin insulating layer.

In the latter case, the hollow body 11 may be composed, for example, of steel, with a thin ceramic coating being provided as the insulating layer. The resistive paste 12 is printed and sintered onto this ceramic coating.

In the flow-through heater illustrated FIG. 1, one end of the tube 13 is employed as the inlet and the other end of the tube, not shown in FIG. 1, is used as the outlet for flow-through heater 10.

Figure 2:
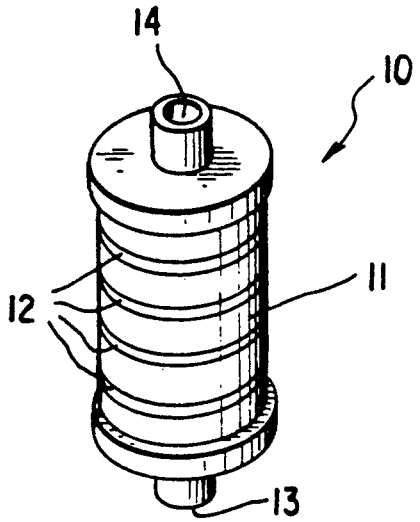
FIG. 2 is a perspective view of a cylindrical flow-through heater.

The flow-through heater 10 shown in a perspective view in FIG. 2 is also composed of a hollow body 11 having an inlet 13 and an outlet 14 as well as a resistive paste 12 printed and sintered onto the hollow body so as to form the electrical resistance heating element for flow-through heater 10.

As in the case of the tubular flow-through heater illustrated in FIG. 1, hollow body 11 of the embodiment illustrated in FIG. 2 is also produced of an electrically non-conductive material or is provided with an insulating layer.

In the embodiments according to FIGS. 1 and 2, the resistive paste 12 is printed onto each of respective hollow bodies !1 in the form of circumferential helixes.

Figure 3:
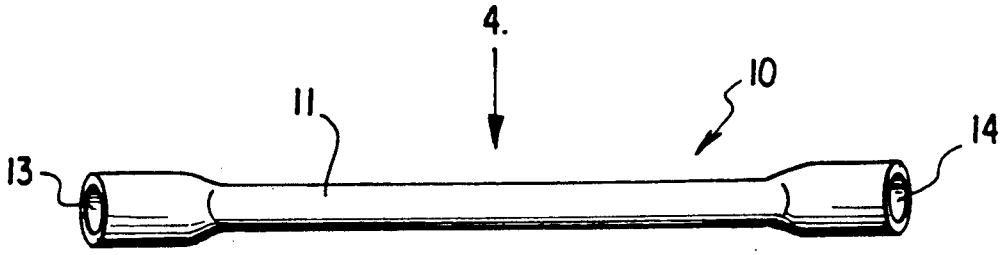
FIG. 3 is a view of a tubular, flattened flow-through heater.
Figure 4:
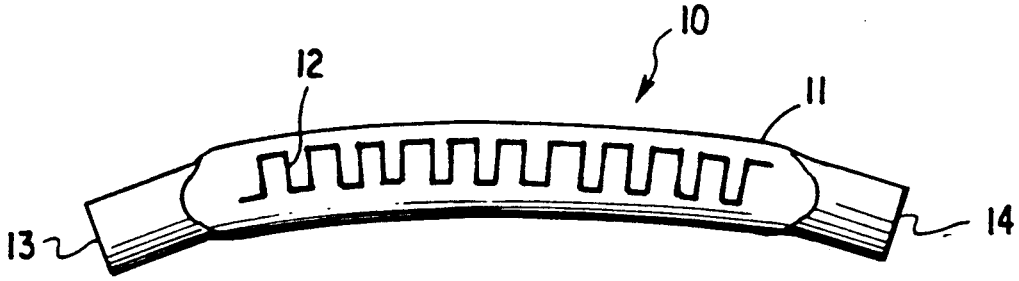
FIG. 4 is a view in the direction of arrow IV of FIG. 3.
Figure 8A:
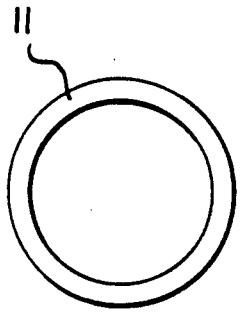
FIG. 8*a* to FIG. 8*g*, are various cross-sectional configurations for flow-through heaters according to the invention.
Figure 8B:
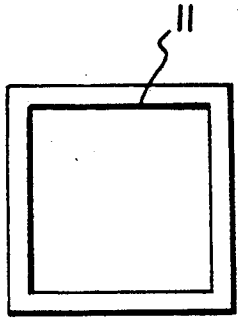
Figure 8C:
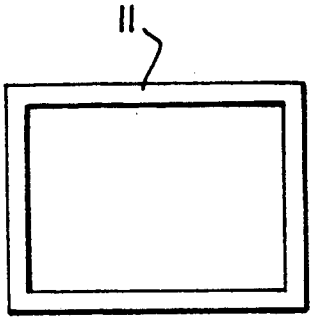
Figure 8D:
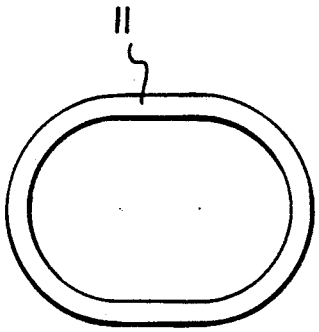
Figure 8E:
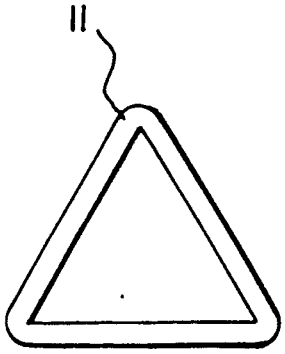
Figure 8F:
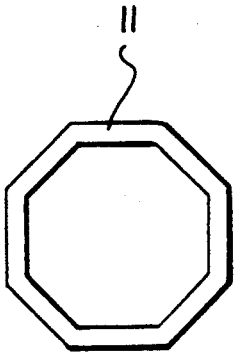
Figure 8G:
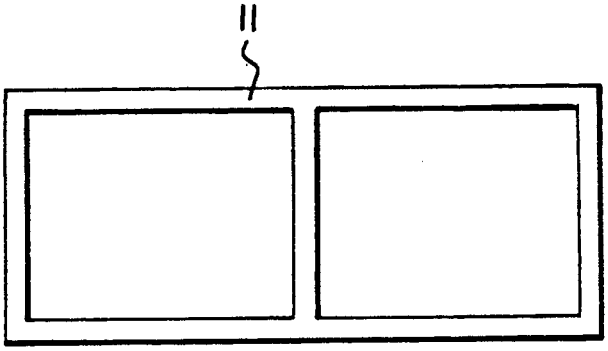

FIGS. 3 and 4 show a further embodiment of a tubular flow-through heater 10.

Here, the center region of the tubular hollow body 11 is flattened so as to create substantially planar surfaces for the imprinting with resistive paste 12.

Inlet 13 and outlet 14 of flow-through heater 10, however, are left cylindrical so as to be able to connect without difficulty corresponding hose-type connecting members to flow-through heater 10.

FIG. 4 illustrates how the tubular shaped flow-through heater 10 is curved.

FIG. 5, in conjunction with FIG. 6, illustrates the many different possibilities that exist with respect to the design of flow-through heaters 10 according to the invention.

For example, two mutually parallel tube sections 16 which are connected with one another by means of a center web 15, may be provided with an electrical resistance heating element by means of an imprinted and sintered-on resistive paste 12 and the two tube sections may be connected with one another by means of a connecting piece 17.

In the embodiment illustrated in FIGS. 5 and 6, tube sections 16 are also flattened so as to provide a surface that is as planar as possible for the imprinting of resistive paste 12.

The embodiment according to FIG. 7 illustrates that hollow bodies 11 of any desired curvature can be provided with an electrical resistance heating element in the form of an imprinted and sintered-on resistive paste 12 so as to create a flow-through heater 10.

FIGS. 8*a* to 8*g* illustrate that ultimately any desired cross-sectional configurations can be employed for the hollow bodies 11, particularly those which have planar faces in any case, such as square, rectangular or polygonal profiles; multi-chamber profiles (see FIG. 8*g*) may also be employed.

The illustrated embodiments serve merely to indicate the multifaceted design possibilities for flow-through heaters according to the invention.

Particularly in connection with flow-through heaters for coffee or tea makers it is often important to design the flow-through heater in such a manner that it is adaptable to the exterior shape of the coffee or tea maker. This requirement in particular can be optimally met with the present invention.

For the case that flow-through heater 10 is to have a hollow body 11 made of an electrically non-conductive material, aluminum oxide is preferably employed.

I claim:

1. A flow-through fluid heater for a coffeemaker or teamaker, comprising a tubular hollow body having an exterior surface, flattened regions, a fluid inlet and a fluid outlet, and an electrical resistance heating element which at least partially surrounds said hollow body for heating a fluid received therein, wherein said hollow body comprises an electrically non-conductive material and said electrical resistance heating element comprises a resistive paste which is printed and sintered onto said flattened regions.

2. A flow-through fluid heater for a coffeemaker or teamaker according to claim 1, wherein said hollow body is made of aluminum oxide.

3. A flow-through fluid heater for a coffeemaker or teamaker according to claim 1, wherein said hollow body is made of steel having a ceramic coating.

4. A flow-through fluid heater for a coffeemaker or teamaker according to claim 1, wherein said hollow body comprises two tube sections which are connected with one another by a connecting piece.

5. A flow through fluid heater for a coffeemaker or teamaker according to claim 1, wherein said fluid inlet and the fluid outlet have cylindrical cross-sections which are different than the cross-sectional configuration of said hollow body.

* * * * *